US010036583B2

(12) United States Patent
Sollie et al.

(10) Patent No.: US 10,036,583 B2
(45) Date of Patent: Jul. 31, 2018

(54) LIQUID SEPARATOR FOR AN EVAPORATOR SYSTEM

(75) Inventors: Björn Sollie, Lund (SE); Mats Stromblad, Bastad (SE); Claes Stenhede, Verona (IT)

(73) Assignee: ALFA LAVAL CORPORATED AB, Lund (SE)

( * ) Notice: Subject to any disclaimer, the term of this patent is extended or adjusted under 35 U.S.C. 154(b) by 1729 days.

(21) Appl. No.: 12/741,249

(22) PCT Filed: Nov. 4, 2008

(86) PCT No.: PCT/SE2008/051257

§ 371 (c)(1),
(2), (4) Date: Jul. 21, 2010

(87) PCT Pub. No.: WO2009/061268

PCT Pub. Date: May 14, 2009

(65) Prior Publication Data

US 2010/0300143 A1 Dec. 2, 2010

Related U.S. Application Data

(60) Provisional application No. 60/988,136, filed on Nov. 15, 2007.

(30) Foreign Application Priority Data

Nov. 5, 2007 (SE) ..... 0702440

(51) Int. Cl.
*F28F 3/04* (2006.01)
*F25B 39/02* (2006.01)
(Continued)

(52) U.S. Cl.
CPC ..... *F25B 43/00* (2013.01); *F25B 2341/0011* (2013.01); *F25B 2400/23* (2013.01); *F28D 9/00* (2013.01)

(58) Field of Classification Search
CPC .... F25B 2339/023; F25B 39/02; F25B 43/00; F25B 2400/23; F28D 9/00
(Continued)

(56) References Cited

U.S. PATENT DOCUMENTS 1,794,110 A * 2/1931 Gay ..... 62/471
2,544,937 A * 3/1951 Philipp ..... 62/518
(Continued)

FOREIGN PATENT DOCUMENTS

EP 0 071 062 A 2/1983
EP 1 808 654 7/2007
(Continued)

OTHER PUBLICATIONS

European Search Report dated Feb. 20, 2013, by the European Patent Office, in corresponding European Patent Application No. 08848064. (5 pages).

*Primary Examiner* — David Teitelbaum
*Assistant Examiner* — Martha Tadesse
(74) *Attorney, Agent, or Firm* — Buchanan Ingersoll & Rooney PC

(57) ABSTRACT

Liquid separator (2), designed as a U-shaped pipe (5) and arranged essentially horizontally, for a plate heat exchanger evaporator (1) system for separation of liquid droplets from vapor transported from the evaporator to the separator.

22 Claims, 2 Drawing Sheets

(51) Int. Cl.
*F25B 43/00* (2006.01)
*F28D 9/00* (2006.01)

(58) Field of Classification Search
USPC .... 62/512, 509, 117, 347; 95/262, 260, 206; 210/511, 175
See application file for complete search history.

(56) References Cited

U.S. PATENT DOCUMENTS 3,955,374 A * 5/1976 Zearfoss, Jr. ..... 62/197
4,035,171 A 7/1977 Reed et al.
4,359,329 A 11/1982 Willeitner
4,390,351 A * 6/1983 Matsui ..... B01D 19/0057 210/512.1
4,414,112 A * 11/1983 Simpson et al. ..... 210/512.1
4,661,127 A * 4/1987 Huntley ..... 96/184
4,843,837 A * 7/1989 Ogawa et al. ..... 62/324.1
4,866,951 A * 9/1989 Masterson, II ..... 62/503
4,918,944 A * 4/1990 Takahashi et al. ..... 62/471
5,505,060 A * 4/1996 Kozinski ..... 62/503
5,526,684 A * 6/1996 Liu et al. ..... 73/200
5,678,419 A * 10/1997 Sanada et al. ..... 62/205
5,832,736 A * 11/1998 Yoshioka et al. ..... 62/225
5,997,284 A * 12/1999 Gustafson ..... B01D 19/0042 431/202
6,189,322 B1 * 2/2001 Ishihara et al. ..... 62/114
6,405,542 B1 * 6/2002 Matta ..... F25B 41/003 62/470
6,413,299 B1 * 7/2002 Haukeness ..... 95/241
6,880,360 B2 * 4/2005 Barratt et al. ..... 62/473
7,040,117 B2 5/2006 Nishida et al.
7,540,902 B2 * 6/2009 Esparza ..... B01D 19/0042 210/537
7,690,219 B2 * 4/2010 Suzuki et al. ..... 62/512
2005/0039486 A1 * 2/2005 Knoll ..... F25B 39/022 62/512
2006/0191672 A1 * 8/2006 Stenhede ..... F28D 9/0006 165/145
2007/0163296 A1 * 7/2007 Suzuki ..... F25B 9/008 62/512
2009/0071190 A1 * 3/2009 Potthoff ..... F25B 9/006 62/614
2010/0000248 A1 * 1/2010 Okamoto ..... F25B 9/008 62/238.6
2010/0154467 A1 * 6/2010 Fujimoto ..... F25B 1/10 62/498
2010/0193156 A1 * 8/2010 Nakatani ..... F24D 3/18 165/63
2011/0016892 A1 * 1/2011 Sonninen ..... F25B 43/00 62/85

FOREIGN PATENT DOCUMENTS

EP 1 855 068 11/2007
JP 6-117728 A 4/1994
JP 7-139854 A 6/1995
JP 9-196511 7/1997
WO 96/20382 7/1996
WO WO 00/51707 9/2000
WO 03/100338 A1 12/2003
WO 2007/022777 A1 3/2007
WO 2007/083624 A1 7/2007

* cited by examiner

LIQUID SEPARATOR FOR AN EVAPORATOR SYSTEM

This application is a US national phase application under 35 U.S.C. § 371 of International Application serial number PCT/SE2008/051257, filed Nov. 4, 2008, and claims the benefit of a foreign priority application filed in Sweden, serial number 0702440-9, filed Nov. 5, 2007, and also claims the benefit under 35 U.S.C. § 119(e) of U.S. provisional application Ser. No. 60/988,136, filed Nov. 15, 2007.

FIELD OF THE INVENTION

The present invention relates to a liquid separator to be used with a refrigeration evaporator system.

BACKGROUND

In refrigeration evaporator systems the refrigerant leaves a condenser as a slightly sub-cooled liquid at a high temperature and pressure. Before the refrigerant enters the evaporator the pressure of the refrigerant has to be brought down to the evaporating pressure and temperature by expanding the refrigerant. In this process a part of the refrigerant vaporises. The energy released by the cooling/expansion is absorbed by the evaporating refrigerant.

The evaporators and condensers used in these systems is often plate heat exchangers comprising a plate pack made of a number of assembled heat transfer plates forming between them interspaces. In most cases, every second plate interspace communicates with a first inlet channel and a first outlet channel, each plate interspace being adapted to define a flow area and to conduct a flow of a first fluid between said inlet and outlet channels. Correspondingly, the other plate interspaces communicate with a second outlet channel for a flow of a second fluid. Thus the plates are in contact with one fluid through one of their side surfaces and with the other fluid through the other side surface, which allows a considerable heat exchange between the two fluids.

Plate heat exchangers of today have heat transfer plates, which in most cases are made of sheet metal blanks which have been pressed and punched to obtain their final shape. Each heat transfer plate is usually provided with at least four ports consisting of through holes punched at the four corners of the plate. The ports of the different plates define said inlet and outlet channels, which extend through the plate heat exchanger transversely of the plane of the plates. Sealing means are arranged around some of the ports in every second plate interspace, round the other ports so as to form two separate channels for the first and the second fluid, respectively. The sealing could be performed by means of gaskets, welding or brazing.

Since considerable fluid pressure levels are obtained in the heat exchanger during operation, the plates need to be sufficiently rigid in order not to be deformed by the fluid pressure. The use of plates made of sheet metal blanks is possible only if the plates are somehow supported. This is usually achieved by the heat transfer plates being formed with some kind of corrugation so that they bear against each other at a large number of points.

The plates may be clamped together between two flexurally rigid end plates or frame plates in a frame and thus form rigid units with flow channels in every plate interspace. The end plates are clamped against each other by means of a number of clam bolts which engage both plates in holes along the circumference of each end plate. Some plate heat exchangers are joined by welding or soldering, wherein the end plates protect the heat transfer plates of the heat exchanger.

Refrigerant evaporators are classified according to how the expansion is arranged. The circulation evaporator may be a thermosiphon, pump or ejector. The two-phase mixture that leaves the expansion valve separates into vapour and liquid in a separator. The liquid mixes with circulating liquid from the evaporator and once more enters the evaporator. The vapour mixes with the vapour from the evaporator and leaves for the compressor.

This type of evaporator always operates with much less than 100% evaporation. The heating surface is thus always wetted by the refrigerant. The heat transfer coefficient is high, thus requiring only a small heat transfer area, but a separator is necessary.

The separator in a flooded system has one or more of the following important functions:

- To separate liquid droplets from the vapour
- To accumulate the refrigerant content of the system during a shut down.
- To even out changes of volume in the system during load variations.
- Under certain conditions, the refrigerant may foam and space has to be provided.
- To provide a static liquid level which then provides the driving force for the circulation or the suction head for a circulation pump.
- The liquid level is also used to control the expansion valve. This is sometimes made in the high-pressure receiver, sometimes in the low-pressure receiver.
- To act as an oil trap/separator.

The separation of the vapour and the liquid is obtained by gravitational forces, sometimes assisted by centrifugal forces, which allow the heavier liquid droplets to settle.

Accordingly, liquid droplets small enough to be kept in suspension by molecular movements, Brownian movements, do not separate. In practice, liquid droplets sometimes much larger than Brownian droplets do not separate either, but there are additional methods to separate them.

Basically there are two types of separators, the horizontal and the vertical type and a hybrid type separator. The horizontal separator has the following properties:

- The flow is horizontal. If the residence time is sufficiently long, the droplets separate regardless the velocity.
- The hold up time and the height of the separation space determine the efficiency.
- When the liquid level increases, the cross section decreases, the velocity, increases and the hold up time decreases, i.e. a decreased separation.
- It is easy to connect two or more evaporators or an evaporator with double exits. Double entrances reduce the velocity by 50% but also the separation distance preserving the efficiency.

A vertical separator has the following properties:

- The vapour flow is mainly upwards. If the velocity is lower than the separation velocity the droplets separate. Variation of the liquid content causes a correspondingly large variation of the liquid level.
- The liquid level does not affect the vapour velocity.
- The liquid body is easily agitated, providing a variable signal to the TEV and a difficult oil separation.
- It occupies little floor space, but more head space.
- The vertical separator should not be mixed with the cyclone. The cyclone separates particles or droplets by entering the vapour tangentially at a high velocity, thereby creating a strong centrifugal force, which effects the actual separation. Separation is very effective, but the pressure drop is also very high.

It is difficult to connect two or more evaporators or an evaporator with double exits.

A hybrid separator has the properties:

It is basically a horizontal separator with a vertical vessel attached to the bottom.

The liquid level is maintained in this vessel. Separation occurs in the horizontal part. The velocity is independent of the liquid level.

The total refrigerant filling is less than the horizontal.

The liquid level is less affected by the flashing refrigerant or the circulating vapour-liquid mixture.

A traditional separator is made of carbon steel and is short and bulky with a large diameter. However, this construction adds a considerable weight to an evaporator and the size and shape thereof give rise to problems concerning height restrictions, etc. The cost for a short and wide separator is also much higher than for an elongated and slender separator.

A traditional separator with its weight is held up by external support constructions with space allowances over the separator making the length of connecting pipes from the evaporator to the separator relatively long.

Moreover, the separator normally contains a mass of refrigerant that is hazardous, e.g. for reasons of toxicity, flammability, decomposition, etc.

SUMMARY OF THE INVENTION

The object of the present invention is to eliminate or at least alleviate the above referenced drawbacks and limitations of the present evaporator separators. The separator is designed as a U-shaped pipe comprising two essentially parallel pipes interconnected by means of a pipe portion, said pipes being arranged essentially horizontally.

By the present invention an evaporator separator has been achieved which makes the overall evaporator system more compact and less space consuming as well as at the same time making the separation more efficient. The compact design of the separator is also beneficial for economic reason.

Due to the small diameter of the separator pipes the weight of the separator is reduced. The smaller size of the separator makes it possible to utilize materials of higher grade and still achieve an economic solution. In this way surface coating against corrosion may be avoided and costs lowered. The small diameters allows for standard pipe components accessible on the market to be used rather than specifically tailor made components.

Furthermore, the refrigerant charge to the separator is reduced and accordingly the environmental and personal safety is enhanced.

Preferred embodiments of the invention have been achieved by the invention having the characterizing features of dependent claims 2-11.

Other objects, features, advantages and preferred embodiments of the present invention will become more apparent from the following detailed description when taken in conjunction with the drawings and the appended claims.

BRIEF DESCRIPTION OF THE DRAWINGS

Preferred embodiments of the invention will now be described in more detail below, reference being made to the accompanying drawings, which by way of example illustrate currently preferred embodiments of the invention.

DETAILED DESCRIPTION OF EMBODIMENTS OF THE INVENTION

Figure 1:
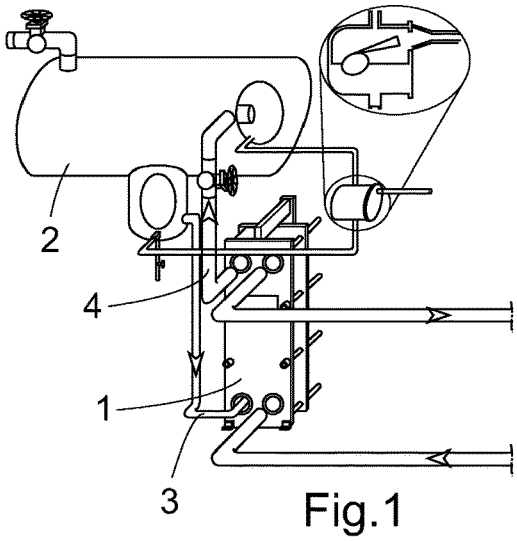
FIG. 1 is a perspective view of a known separator for an evaporator system.
Figure 2:
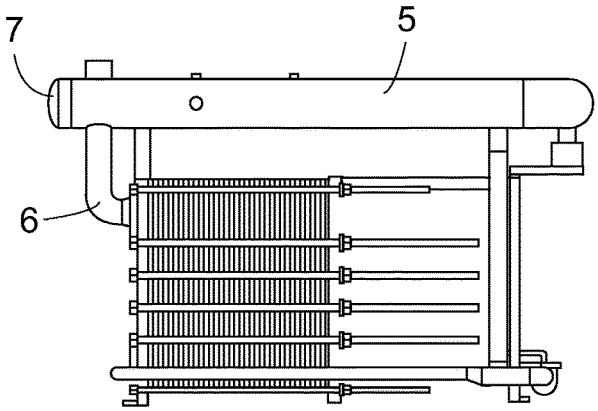
FIG. 2 is side view of the separator of the invention.
Figure 3:
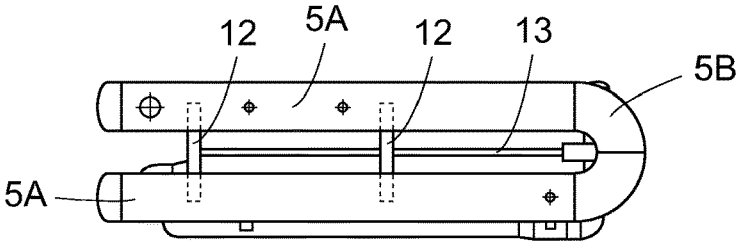
FIG. 3 is a top view of the separator in FIG. 2 of the invention.
Figure 4:
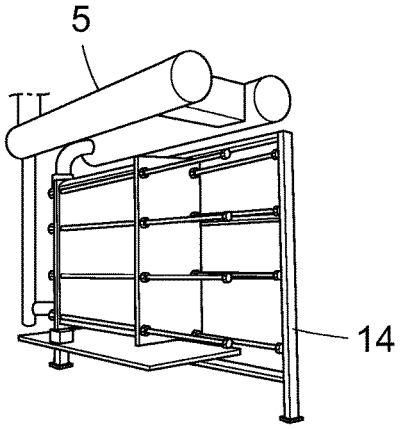
FIG. 4 is a perspective view of a first embodiment of the separator according to the present invention.
Figure 5:
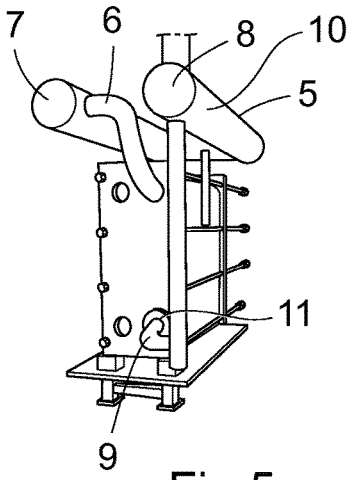
FIG. 5 is another perspective view of the separator according to FIG. 2-4.

In FIG. 1 the general principle for a plate heat exchanger circulation evaporator system is shown. The evaporator 1 is connected to a vapour liquid separator 2 by two pipes 3, 4, a lower pipe leg 3 feeding the evaporator 1 and an upper pipe leg 4 which returns the partially evaporated liquid.

In case of an insoluble oil heavier than the refrigerant present in the refrigeration system, e.g. oil/ammonia, the oil is drained from the separator bottom and is collected in a vessel (not shown) at the lowest part of the refrigeration system and may be drained from there. The primary duty of the oil in the system is to lubricate moving parts of the compressors and to seal in order to prevent refrigerant from leaking. It is important that oil is prevented from reaching the evaporator and the oil is therefore collected before entering the evaporator and returned to the compressor.

The separator 2 always maintains a liquid level usually well above the top of the evaporator. The evaporator 1 is thus always filled with liquid and this type of evaporator is normally called a flooded flow evaporator.

Depending on the driving force for the circulation, flooded flow evaporators are classified as thermosiphon evaporators, where the driving force is the natural density differences between the two legs of the system separator-evaporator, or forced flow evaporators, where the driving force is a pump or an ejector.

The circulation—the ratio of the total refrigerant amount entering the evaporator and the amount evaporated—may vary from about 5 to 10 for a shell- and tube heat exchanger to about 1.2 in a plate heat exchanger, of either the brazed or semi welded type. A smaller circulation rate earns smaller pipe work and separator and a reduction of the total refrigerant content of the plant.

The heating surface is thus always wetted by the refrigerant. This is important, as the heat transfer is then two phase convective of a vapour in a liquid, i.e. high as compared to the direct expansion evaporator, where the heat transfer mode, at the end of the evaporation and the superheating of the vapour, is gas heat transfer, i.e. low.

At large capacities, the relatively small size of the flooded flow evaporator is favoured compared to the dry expansion evaporator. In this case, the efficiency of the evaporator is more important than the extra cost of a separator.

The smaller dry expansion brazed plate heat exchangers are thus normally not used but as auxiliary coolers like oil coolers in large plants. Larger brazed plate heat exchangers can be used as flooded flow evaporators for non ammonia refrigerants.

Ammonia, favours the use of flooded flow evaporators and the recent development of fusion bonded plate heat exchangers could increase their use here. The separator according the present invention favours ammonia to be used for lower capacities than is common today For economic reasons the thermosiphon system is often considered the best solution for a flooded flow evaporator since the cost for a pump and its operation is saved. The circulation rate is, however, very dependent on the heat transfer and pressure drops in the various parts of the system, which in their turn are dependent on the circulation, i.e. there is an integration and interdependence between pressure drop, circulation rate and heat transfer in the circulating system.

By definition thermosiphon means circulation owing to density differences between the fluids in two connecting legs. When the unit in FIG. 1 is not operating but filled with liquid refrigerant and both valves are open, the refrigerant level in the separator is the same as in the evaporator.

When liquid enters the evaporator 1 on the other side, the refrigerant heats up and slowly bubbles start to form. The channels are then partly filled with ascending bubbles. Thus, the mean density in the pipe leg 3 formed by the evaporator is much lower than in the pipe leg 4 formed by the separator and the descending pipe.

Accordingly, the two pipe legs 3, 4 are not in balance and the refrigerant gradually enters the evaporator 1 from the separator 2 via the descending pipe 4. At the top of the evaporator 1, a two-phase mixture is pushed into the separator 2 and the liquid and vapour separate. At the bottom of the evaporator 1, the entering refrigerant heats up and finally starts to boil. Thus, a two-phase mixture is always maintained in the channels.

As the circulation rate increases, the various pressure drops increase and finally the driving force is balanced by retarding forces. The system is then in balance and a constant refrigerant flow enters the evaporator while a certain fraction of the flow evaporates.

When the liquid-vapour mixture enters the separator 2, it is saturated. The liquid droplets separates from the vapour and the refrigerant enters the evaporator 1 again but it is now not saturated. The temperature is the same as in the separator 2, but the pressure is higher, increased with the static head from the liquid level to the inlet, i.e. the refrigerant is sub-cooled.

This means that in the first part of the heat exchanger there will be no boiling, just a temperature increase. However, as the refrigerant rises, it will decrease in pressure, reducing the sub-cooling.

These two effects—increasing temperature and decreasing pressure—mean that after a while boiling is reached and the refrigerant starts to boil, albeit at a higher temperature than at the exit. The pressure continues to decrease because of the changing height and the pressure drop, and the refrigerant, now saturated, will continue ascending with decreasing temperature until it reaches the separator and the loop is closed.

FIG. 2-6 show the liquid separator 2 according to the present invention which is designed as a U-shaped pipe 5 comprising two elongated essentially parallel pipes 5A interconnected by means of a pipe portion 5B, said pipes 5A being arranged essentially horizontally. Of course, the separator pipe 5 may be made in one piece. The pipes 5A, 5B may be standard pipes with a diameter between 100 and 400 mm. The length of the separator pipe 5 may be varied depending on the capacity and the evaporation temperature of the evaporator. Preferably the separator pipe 5 has a length and width approximately corresponding to the length and width of the evaporator 1. The two-phase refrigerant flow leaves the evaporator 1 from a top connection 6 of the plate heat exchanger evaporator 1 and enters the separator 2 into a first end 7 of the separator 2. The refrigerant liquid droplets are separated from the vapour in the separator 2 and the liquid refrigerant is circulated back from a second end 8 of the separator to a bottom connection 9 of the plate heat exchanger evaporator 1. From the separator 2 the dry vapour leaves at the second end 8 to a compressor.

By arranging the separator pipe 5 mainly horizontally a very efficient separation is achieved and the liquid droplets can separate from the vapour during the transportation of the vapour through the length of the separator pipe 5. A small radius of curvature of the U-shaped pipe further improves the liquid separation and makes the separator compact.

Optionally an oil drain (not shown) may be provided before the liquid refrigerant enters the bottom connection 9 of the evaporator 1. In this case it is important that the oil drain is arranged at the lowest point of the evaporator system.

Also, a demister 10 may be located at the end, near and before a suction nozzle with the function in operating conditions to aggregate any small, possibly remaining droplets to larger droplets that will separate to the bottom at a higher speed than small droplets. This prevents liquid from entering through the suction nozzles to the compressor and is used for systems with sudden load variations.

A check valve 11 may be located at the bottom liquid inlet connection 9 to the evaporator 1 and after the oil drain separator. The valve 11 is open at normal operation conditions with a minimum pressure drop of the supplied liquid refrigerant. At start up and sudden load variations the liquid may flow backwards up the liquid supply or drop leg and reach a level inside the separator U-Turn pipe. This reduces the cross flow area in the U-shaped separator pipe 5 which should be avoided due to a reduction of the separator capacity under such circumstances. The check valve function prevents liquid to return backwards up the liquid feed drop leg.

When there is a pressure increase in the evaporator because of start up or sudden load changes the valve 11 will close. The valve has no external regulation or control. It remains closed by gravity at stop condition, open in normal operation and closed at back flow tendencies.

Liquid may be injected into the separator 2 from the high pressure side of the refrigeration system by means of an ejector having the effect of increasing the static suction pressure to the compressor (not shown). A higher suction pressure to the compressor results in a lower power consumption. The relatively small diameter of the U-shaped separator pipe 5 and a direction of the injected high pressure refrigerant co currently with the separating two phase flow results in an increased pressure in the separator 2 after the injection. Injection can also be effected in the wet return line between the evaporator exit and the separator where the ejector effect is utilized further due to the smaller diameter of this pipe.

In a preferred embodiment of the present invention a number of fixed lengths of the pipes are provided to each of the different types of plate heat exchanger evaporators. Consequently, each plate heat exchanger evaporator model is provided with a separator of a fixed diameter but the length of the separator pipe may vary depending on the temperature and the capacity of the evaporator.

In another preferred embodiment of the present invention the U-shaped separator pipe 5 has a bend of preferably 180°. The U-formed shape of the separator 2 increases the separation efficiency in comparison with traditional separators since the separation length is longer than in a traditional separator. For the larger separator diameters the 180° turn can be made of two T-pieces with end-cups to reduce the distance between the two separator legs. A narrow curvature of the U-shaped separator pipe 5 enhances the separation of liquid.

Preferably the separator 2 according to the invention is arranged principally horizontally or slightly inclined on top of the evaporator. In a preferred arrangement the separator is supported with supports 12 on the frame 13 or connection plate and with one support on the plate heat exchanger support column 14. By this construction the separator pipe of the invention is allowed to stretch and shrink with the temperature variations.

Figure 6:
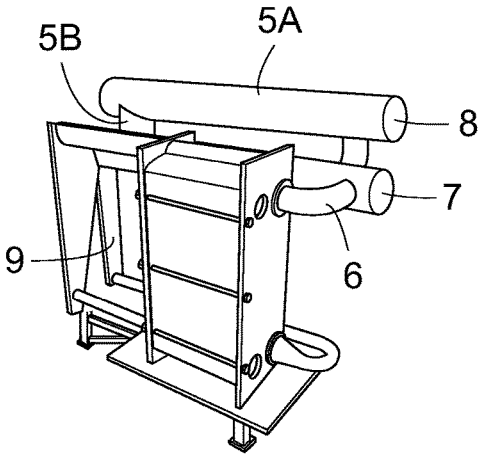
FIG. 6 is a perspective view of a second embodiment of the separator of the invention.

In an alternative embodiment of the present invention the separator is arranged on the upper side of the separator, see FIG. 6. The two separator pipes 5A are arranged one above the other with a connecting pipe portion 5B.

The separator can be made of stainless steel or other alloyed material in order to avoid corrosion without the need for surface treatment and surface coating. As an alternative, it can be made of common carbon steel grades with surface treatment.

By the mainly horizontal arrangement of the liquid separator consisting of to essentially parallel pipes interconnected by a pipe portion into a U-shaped form an efficient liquid separation can be achieved due to the increased length of the separator compared to previously known liquid separators.

Due to the compact design of the separator of the invention a low weight separator is achieved which is less space consuming than previously known liquid separators.

A further advantage with the liquid separator according to the present invention is that it can operate at part loads with maintained cooling efficiency owing to a short wet return line with small pressure drop and adapted driving liquid levels.

Furthermore, the separator 2 of the invention also functions as a connector for safety valves, feed expansion, valves, liquid level control, suction pressure control, oil separation, drip tray and as a lift from floor levels. The liquid level control for traditionally made separators with large diameters is made of a parallel liquid pipe connected to the separator and the liquid drop leg with two stop valves, a level glass and transmitter to control a regulator valve. The invention with small separator diameters allows for inductive transmitters internally mounted. Such level control transmitters allow for lower weight, few components and a reduced leak risk.

It will be readily apparent to one skilled in the art that various substitutions and modifications may be made to the invention disclosed herein without departing from the scope and spirit of the invention.

The invention claimed is:

1. A liquid separator for a plate heat exchanger evaporator system for separation of liquid droplets from vapour transported from the evaporator to the separator, wherein the separator is designed as a U-shaped separator pipe comprising two parallel pipes interconnected by a pipe portion, said pipes being arranged horizontally, each of said parallel pipes extending from the pipe portion and terminating at a respective free end, the two pipes including a first pipe possessing an end remote from the pipe portion and a second pipe possessing an end remote from the pipe portion, the end of the first pipe being connected to the evaporator to introduce into the separator the liquid droplets and vapour from the evaporator, the vapour separated from the liquid droplets and the liquid droplets separated from the vapour leaving the separator at the end of the second pipe.

2. The liquid separator according to claim 1, wherein the separator pipe has a bend of 180°.

3. The liquid separator according to any one of claim 1 or 2 wherein the length of the separator pipe is adjustable.

4. The liquid separator according to any one of claim 1 or 2, wherein the length and width of the separator pipe is configured to approximately correspond to the length and width of the evaporator.

5. The liquid separator according to any one of claim 1 or 2, wherein the separator pipe has a diameter between 100 and 400 mm.

6. The liquid separator according to any one of claim 1 or 2, wherein the entire U-shaped separator pipe is configured to be arranged on top of the evaporator.

7. The liquid separator according to any one of claim 1 or 2, wherein the separator is configured to be arranged on a side of the evaporator.

8. The liquid separator according to any one of claim 1 or 2, wherein the separator is provided with a demister.

9. The liquid separator according to any one of claim 1 or 2, wherein the separator is provided with an ejector injecting high pressure liquid into the separator.

10. The liquid separator according to any one of claim 1 or 2, wherein the separator is made of stainless steel.

11. The liquid separator according to any one of claim 1 or 2, wherein the separator is made of carbon steel with a surface treatment against corrosion.

12. A liquid separator together with an evaporator in a plate heat exchanger evaporator system for separating liquid droplets from vapour transported from the evaporator to the separator, the separator being a U-shaped separator pipe comprising two parallel pipes interconnected by a pipe portion, said pipes being arranged horizontally, one end portion of the U-shaped separator pipe being connected to the evaporator to receive the liquid droplets and the vapour from the evaporator and an opposite end portion of the U-shaped separator pipe also being connected to the evaporator to directly return to the evaporator the liquid droplets which have been separated from the vapour while the vapour which has been separated from the liquid droplets leaves at the opposite end of the U-shaped separator pipe to a compressor, each of said parallel pipes extending from the pipe portion and terminating at a respective free end.

13. The liquid separator according to claim 12, wherein the separator pipe has a bend of 180°.

14. The liquid separator according to claim 12, wherein the separator pipe possesses an adjustable length.

15. The liquid separator according to claim 12, wherein the separator pipe possesses a length and width approximately corresponding to the length and width of the evaporator.

16. The liquid separator according to claim 12, wherein the separator pipe has a diameter between 100 and 400 mm.

17. The liquid separator according to claim 12, wherein the entire U-shaped separator pipe is arranged on top of the evaporator.

18. The liquid separator according to claim 12, wherein the separator is arranged on a side of the evaporator.

19. The liquid separator according to claim 12, wherein the one end portion of the U-shaped separator pipe is connected to a top connection of the evaporator, and the opposite end portion of the U-shaped separator pipe is connected to a bottom connection of the evaporator.

20. The liquid separator according to claim 12, a first one of the two parallel pipes extending from the pipe portion and terminating at a first free end, and a second one of the two parallel pipes extending from the pipe portion and terminating at a second free end, the first free end of the first pipe being remote from the second free end of the second pipe.

21. A liquid separator for a plate heat exchanger evaporator system for separation of liquid droplets from vapour transported from the evaporator to the separator, wherein the separator is a U-shaped separator pipe comprising two parallel pipes interconnected by a curved pipe portion, the pipes being arranged horizontally, each of the parallel pipes extending from the pipe portion and terminating at a respective free end, each of the two parallel pipes possessing a length, the length of each of the two pipes being equal, a first connection at an end of one of the two parallel pipes by way of which two-phase flow is introduced into the separator to flow along the separator and be separated into the liquid droplets and the vapour, and a second connector at an end of the other of the two parallel pipes and through which the liquid droplets separated from the vapour are transported out of the separator directly to the evaporator while the vapour leaves at the end of the other of the two parallel pipes to a compressor.

22. The liquid separator according to claim 19, wherein the opposite end portion of the U-shaped separator pipe is also connected to a compressor so that dry vapor separated from refrigerant liquid droplets is introduced into the compressor.

* * * * *